US010975633B2

(12) United States Patent
Hickl

(10) Patent No.: US 10,975,633 B2
(45) Date of Patent: Apr. 13, 2021

(54) MECHANICAL RUNNING TOOL LOCKOUT DEVICE

(71) Applicant: McCoy Global Inc., Edmonton (CA)

(72) Inventor: Matthew J. Hickl, El Maton, TX (US)

(73) Assignee: MCCOY GLOBAL INC., Edmonton (CA)

( * ) Notice: Subject to any disclaimer, the term of this patent is extended or adjusted under 35 U.S.C. 154(b) by 83 days.

(21) Appl. No.: 16/403,236

(22) Filed: May 3, 2019

(65) Prior Publication Data

US 2020/0347683 A1 Nov. 5, 2020

(51) Int. Cl.
*E21B 19/07* (2006.01)
*E21B 19/10* (2006.01)

(52) U.S. Cl.
CPC ..... *E21B 19/07* (2013.01); *E21B 19/10* (2013.01)

(58) Field of Classification Search
CPC ..... E21B 19/07; E21B 19/10
See application file for complete search history.

(56) References Cited

U.S. PATENT DOCUMENTS

| | | | | |
|---|---|---|---|---|
| 8,100,187 | B2 * | 1/2012 | Begnaud | E21B 19/07 166/381 |
| 8,424,939 | B2 * | 4/2013 | Slack | E21B 19/07 294/86.25 |
| 9,145,734 | B2 * | 9/2015 | Hart | E21B 3/035 |
| 9,416,601 | B2 * | 8/2016 | Mullins | E21B 19/07 |
| 9,896,891 | B2 * | 2/2018 | Mullins | E21B 19/07 |

* cited by examiner

*Primary Examiner* — Matthew R Buck
(74) *Attorney, Agent, or Firm* — Field LLP

(57) ABSTRACT

The present invention is a modification of U.S. Pat. No. 9,416,601 that is incorporated herein as if fully set forth. Once the tool is secure to the tubular, axial translation of the driving nut to the "locked" position prevents selective grip or release. A slot cut in the driven nut and in the surrounding housing allows additional right hand rotation so that a lug is captured on a shoulder to prevent subsequent axial compression of the selective grip assembly, where the tubular grip will be maintained with rotation. By preventing the tool from moving to the "unlocked" position when set down weight from the rig as applied, it can be operated in a variety of common conditions in today's well drilling environments with applied tension or compression as well as rotation in a direction that leaves the lug captured on a ledge adjacent the slot cut in the driven nut.

18 Claims, 11 Drawing Sheets

Unlocked

Locked

Anti Collapse

Unlocked

DETAIL D
SCALE 2 : 12.5
Unlocked

DETAIL E
SCALE 2 : 12.5
Locked

DETAIL F
SCALE 2 : 12.5
Anti Collapse

MECHANICAL RUNNING TOOL LOCKOUT DEVICE

FIELD OF THE INVENTION

The field of the invention is tubular running tools and more particularly tools that are powered by a top drive for normal grip or release of a tubular in a string and more specifically a lock feature to insure the grip of the tubular despite setting down weight which, under normal operation when combined with rotation, causes the tool to release the tubular.

BACKGROUND OF THE INVENTION

During the process of running casing, the well conditions may be difficult and the operator of the casing running tool may need to apply a variety of forces to advance the tubular into the well bore. In the past, it was normal practice to use the tubular weight to advance the tubular into the well. Longer horizontal wells and more challenging well conditions are now requiring operators to apply additional weight from the rig to advance the tubular. Certain top drive operated tools, such as tools shown in U.S. Pat. No. 9,416,601 use top drive weight, or position, to selectively transfer axial rotation into radial extension or retraction of gripping members. When activated, the grip members or slips set or release the tool to the tubular. There is a need to be able to apply an axial load from the top drive to a casing running tool while the tool maintains a positive grip on the tubular without activating a selective grip and release mode of the slips. The drilling process may need to apply rotation to the tubular while cycling through axial tension and compression. These cycles, if applied to the tool in U.S. Pat. No. 9,416,601 would allow the tool to be cycled through the selective set and release position. The friction in downhole wells is inconsistent and provides an uncertain feedback at a surface location, during right and left-hand rotation of the tubular. The combined right- and left-hand rotation of the tubular and axial tension and compression could present a situation in which the tool in U.S. Pat. No. 9,416,601 accidentally releases the grip to the tubular. This situation is best avoided by not allowing the tool to cycle through the set and release position when axial load is applied. The present invention addresses this need. Those skilled in the art will better understand the present invention from a review of the description of the preferred embodiment and the associated drawings while recognizing that the full scope of the invention is to be determined from the appended claims.

The present invention is a modification of U.S. Pat. No. 9,416,601 that is incorporated herein as if fully set forth. The present invention can be incorporated on existing equipment to provide additional operating parameters. Once the tool is secure to the tubular, axial translation of the driving nut to the "locked" position prevents selective grip or release. A slot cut in the driven nut and in the surrounding housing allows additional right hand rotation so that a lug is captured on a shoulder to prevent subsequent axial compression of the selective grip assembly, which insures the grip of the tubular will not be released with rotation. By preventing the tool from moving to the "unlocked" position when set down weight from the rig as applied, the tool can be operated in a variety of well conditions that are becoming more common in today's well drilling environments with applied tension or compression as well as rotation in a direction that leaves the lug captured on a ledge adjacent the slot cut in the driven nut.

DETAILED DESCRIPTION OF THE PREFERRED EMBODIMENT

For context in understanding the operation of the preferred embodiment of the present invention, the description of the original tool from U.S. Pat. No. 9,416,601 is repeated below along with the drawings, FIGS. 1-8 from that patent, all of which are prior art to the present invention.

Figure 1:
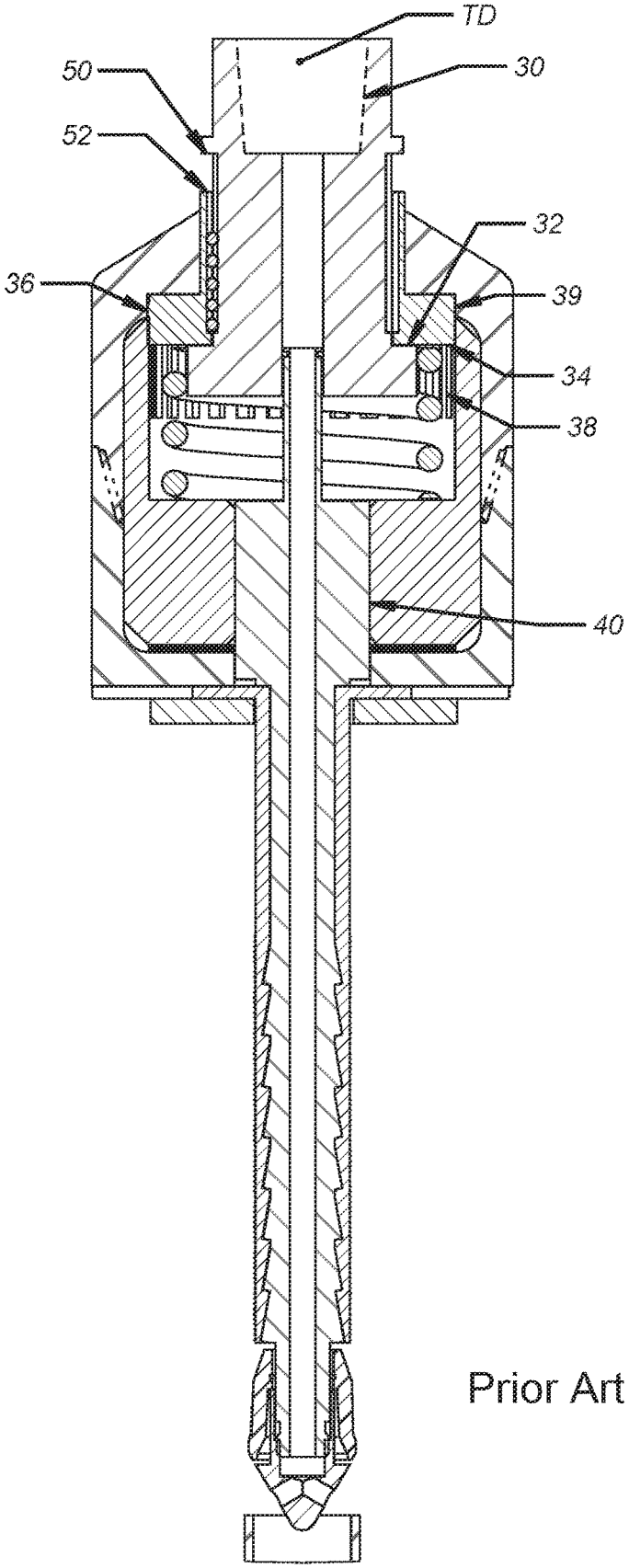
Prior Art FIG. 1
FIG. 1 shows the prior art device in the run in position.
Figure 6:
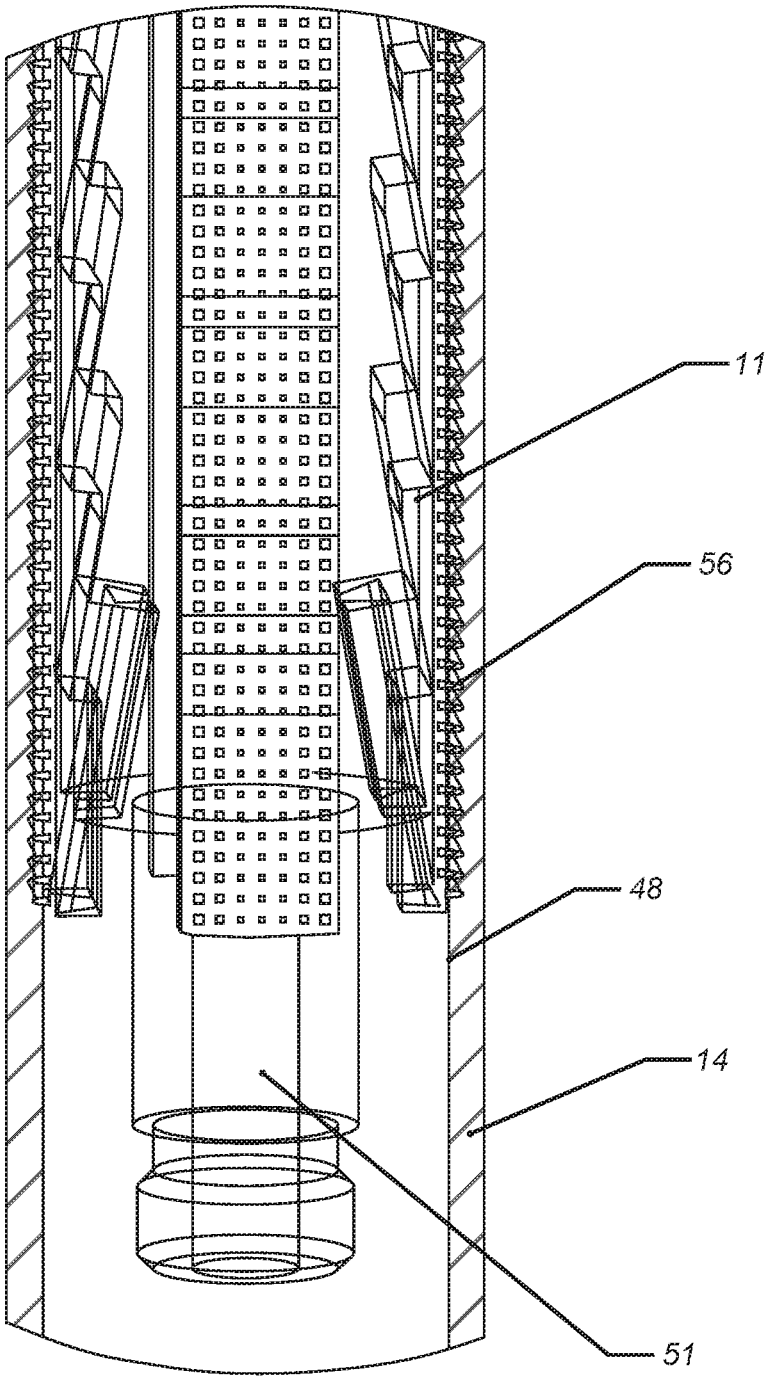
FIG. 6 Prior Art
FIG. 6 is a close up showing three of four prior art slips in the set position.
Figure 7:
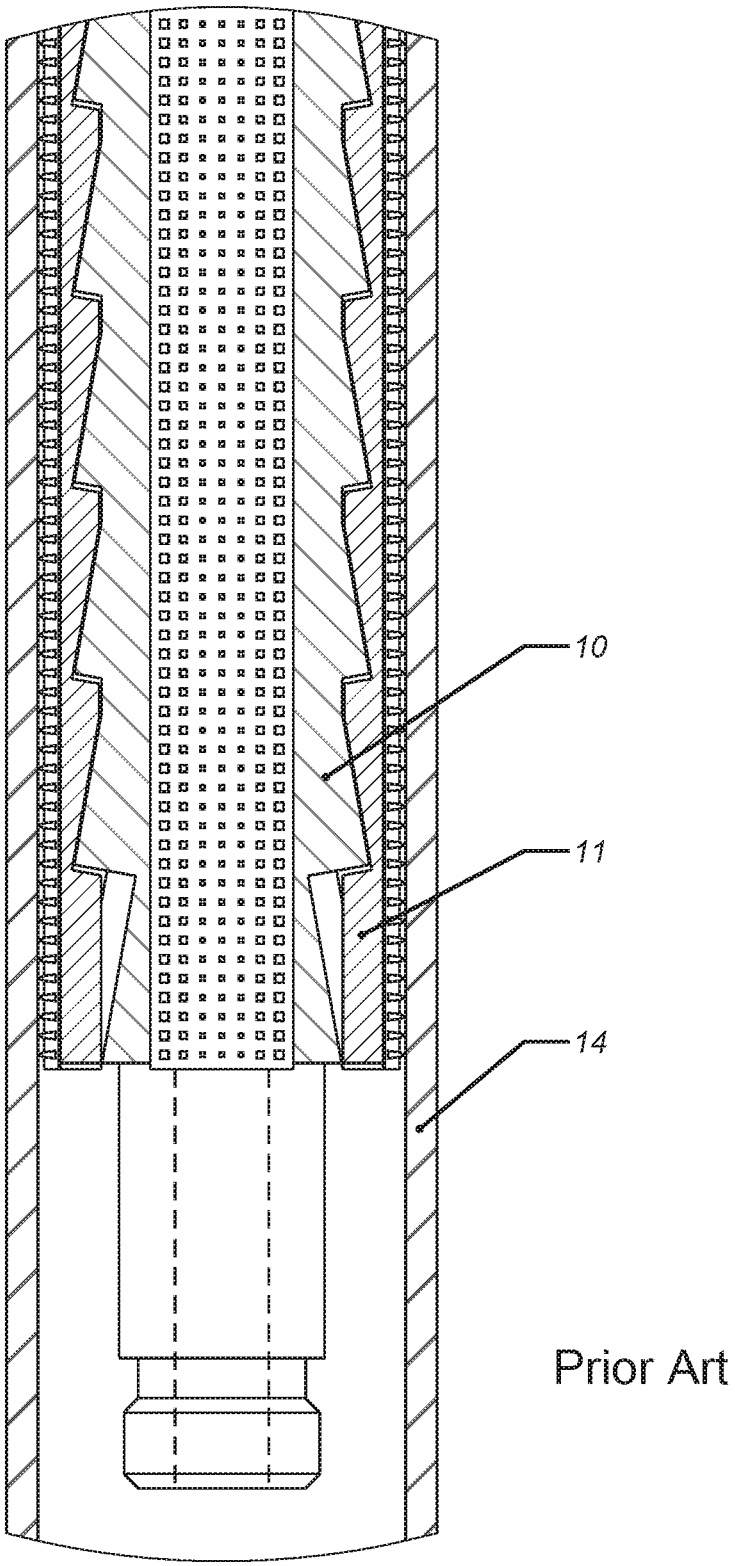
FIG. 7 is the view of FIG. 6 with the slips in the retracted position.
Figure 8:
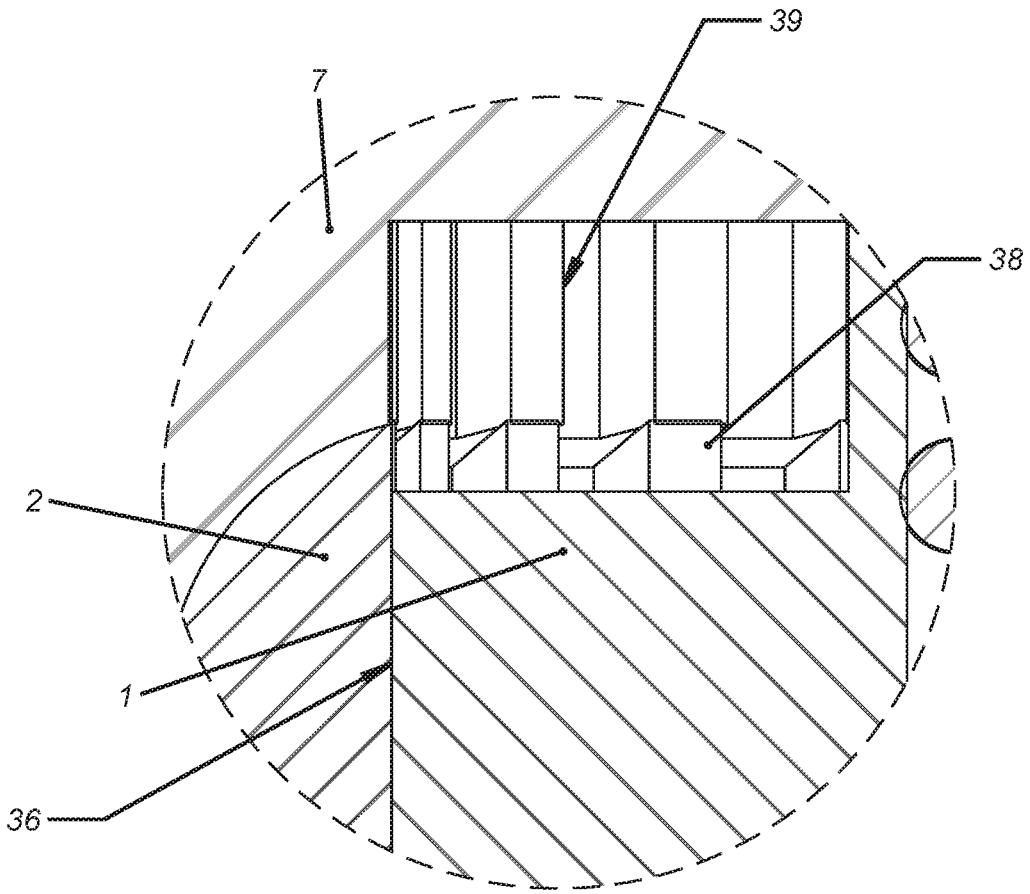
FIG. 8 Prior Art
FIG. 8 is a detailed view of the prior art spline inside the housing wall which acts as a rotational lock when there is no set down weight from the top drive.

Referring to FIG. 1 a top drive TD is schematically illustrated as supporting a top sub 3 at threads 30. The top sub 3 is rotationally locked to driving nut 1 that is captured above shoulder 32 leaving an exposed annular surface 34 on which spring 5 exerts an upward force. Driving nut 1 is rotationally locked to top sub 3 with locking balls 9 although other ways to rotationally lock can be used. Drive gear 1 has an exterior gear pattern or splines 36 that in the FIG. 1 position are engaged with an internal gear or splines 38 on driven nut or gear 2 and with splines 39 on an interior wall of the housing 7 when subjected to the force of spring 5. Splines 39 are best seen in FIG. 8 when the driving gear 1 is pushed down to expose splines 39. Driven nut 2 is mounted to rotate in housing components 6 and 7. Driven nut 2 is connected to actuator 10 at thread 40 such that rotation of the driven nut 2 by driving nut 1 through meshed splines 36 and 38 result in axial translation of actuator 10 into or out of the coils of spring 5. As better seen in FIG. 5 ramps 42 on actuator 10 engage a parallel pattern of inclined ramps 44 on slip segments 46 that are mounted for radial extension into casing 14 for contact with the interior of a casing joint 48 that is shown in FIG. 6. A flow passage 51 leads to outlets 55 for circulating fluid as the casing string is lowered into a borehole. A cup seal 12 has a downward orientation to hold pressure in the casing string 14 with returns coming back to the surface outside the casing string 14.

Figure 2:
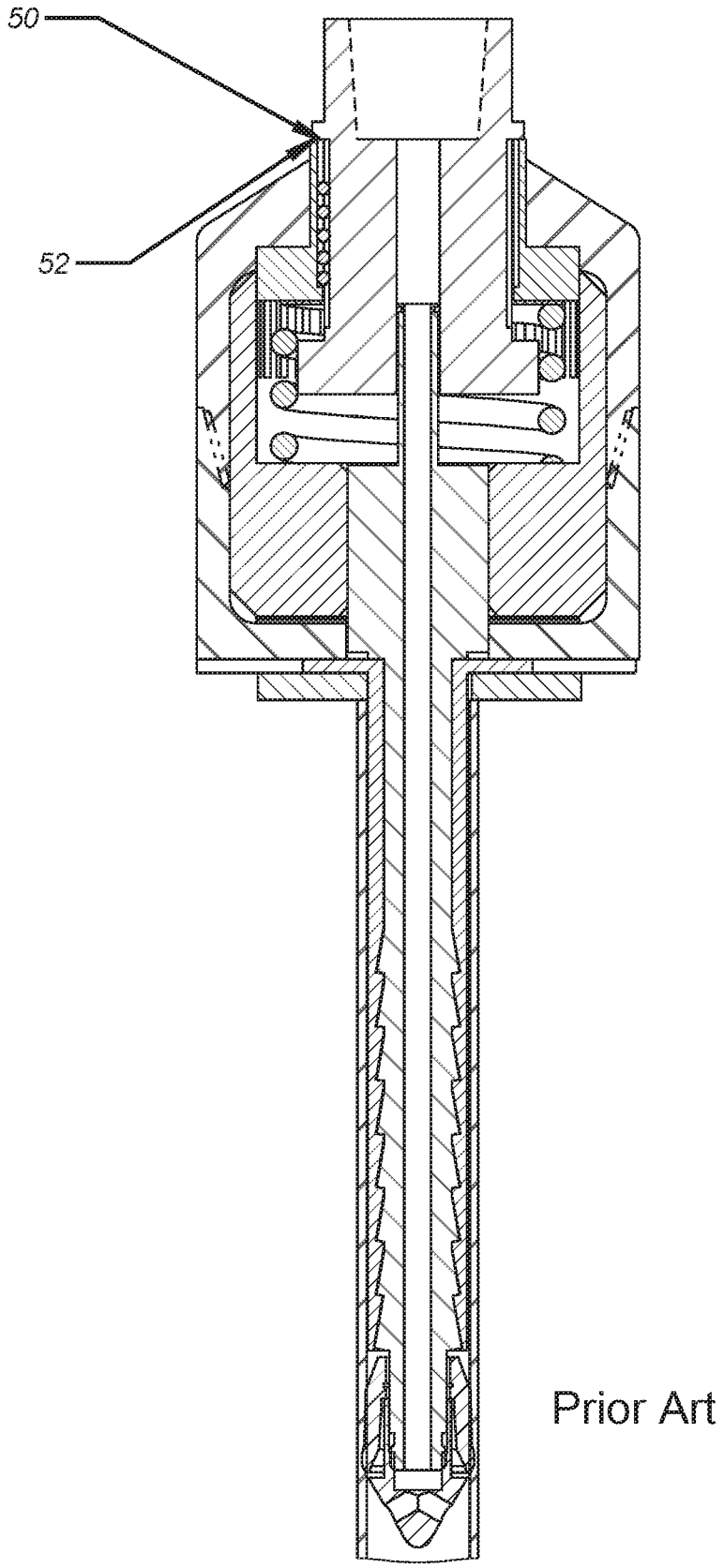
FIG. 2 is the view of FIG. 1 with weight set down before the spring is compressed.
Figure 3:
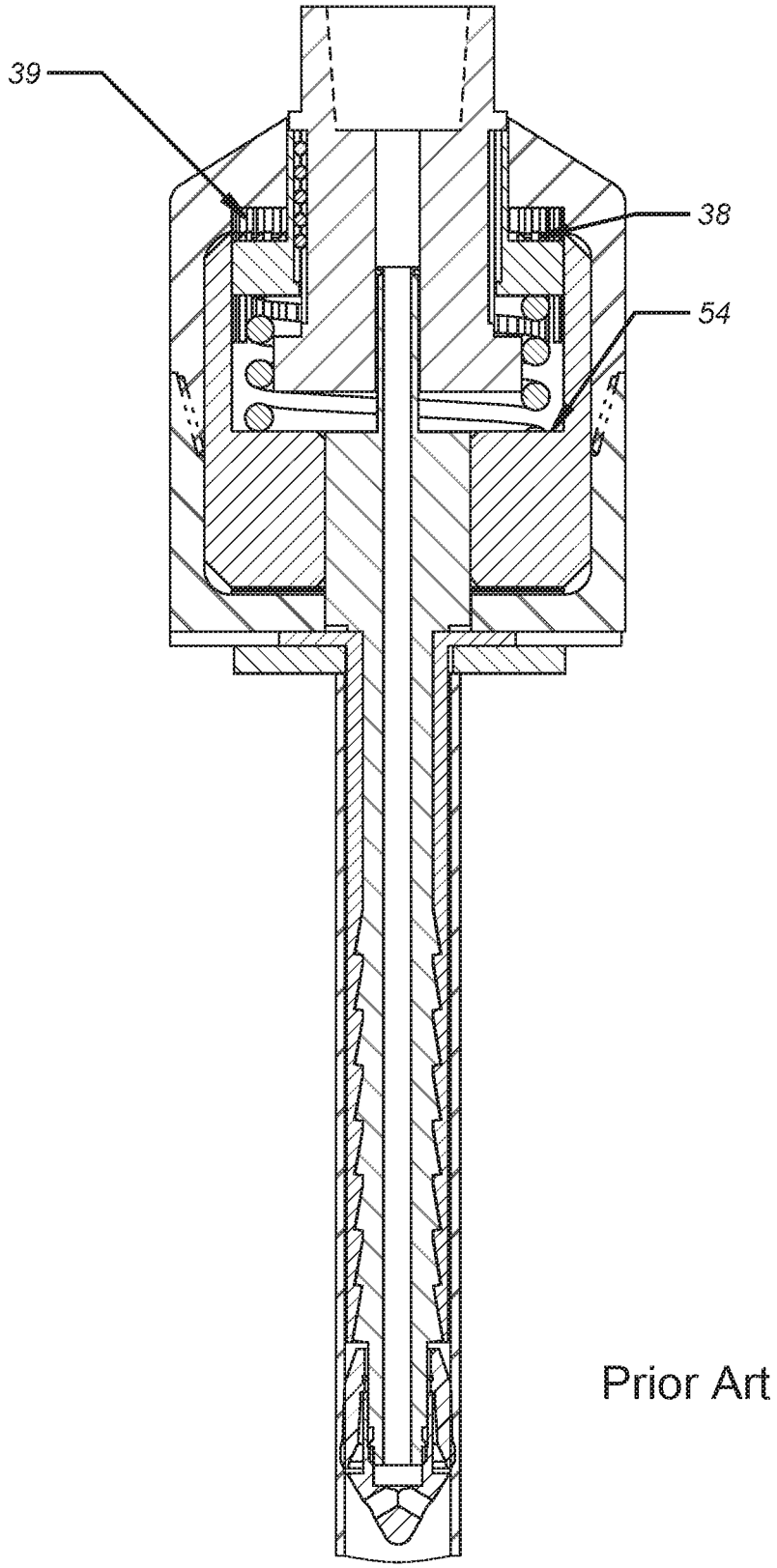
FIG. 3 is the view of FIG. 2 with the spring compressed just before rotation that will extend the slips.
Figure 5:
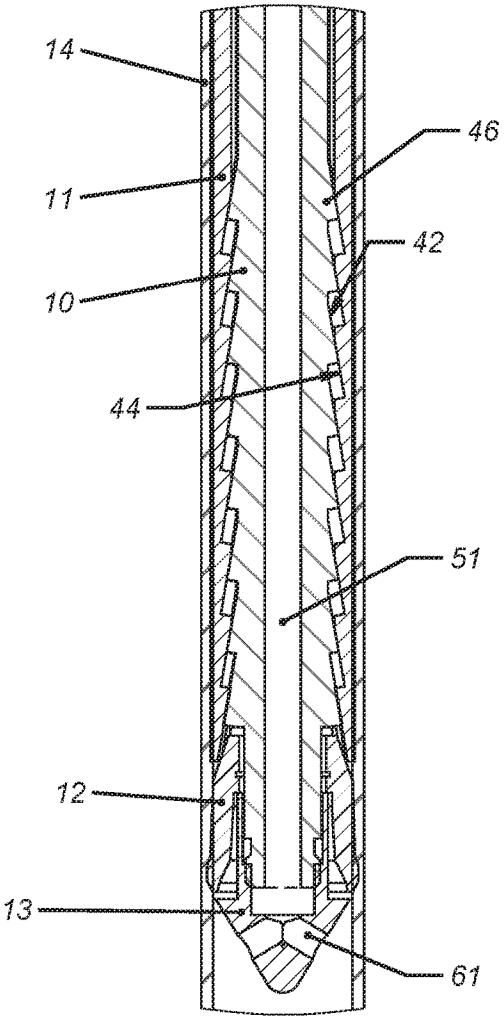
FIG. 5 Prior Art
FIG. 5 shows the prior art slips extended on the multiple ramps of the actuating member.
Figure 4:
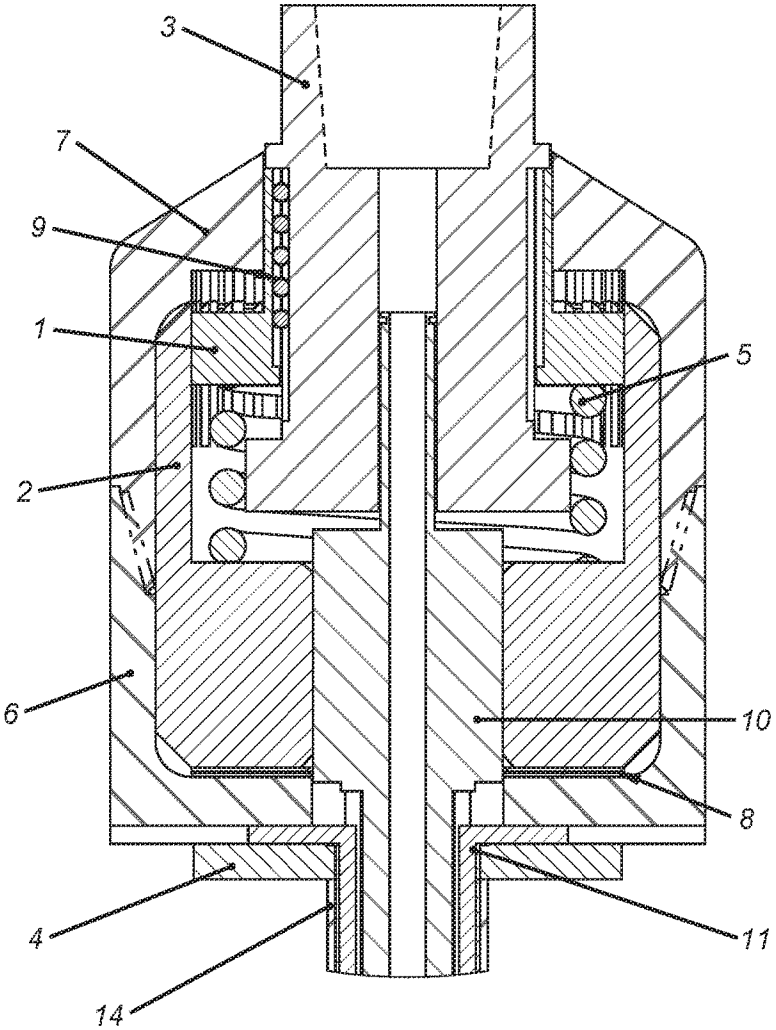
FIG. 4 Prior Art
FIG. 4 shows the prior art actuating member having moved up as a result of rotation that sets the slips.

To make the actuator 10 move axially, weight is set down with the top drive TD pushing the ring 50 against the top 52 of the driving nut 1, as shown in FIG. 2. Further setting down weight compresses spring 5 and moves the splines 36 out of splines 39 and only into 38 to create meshing engagement as shown in FIG. 3. Note that in this position the actuator 10 is about even with the spring support surface 54. At this point rotation of the top drive TD in one direction raises actuator 10 which pulls ramps 42 axially which results in radial movement of the slip segments 46 out until the wickers or grip profile 56 engages the tubular 14 on surface 48. With the slips segments 46 wedged into the tubular 14, the top drive TD is raised up so that the support slips in the rig floor that support the balance of the string below the tubular just threaded to the string, can be removed so that the top drive TD with slip segments 46 engaged to the tubular 48 now supports the string but splines have reengaged due to the return force of spring 5 and the fact that weight is no longer being set down as the entire string is hanging on the slip segments. At this point the splines on the driving nut 1 are engaged to splines 39 on the upper housing 7 so that top drive TD rotation simply turns the housing 6, 7 and with it the slip housing 11 that is secured to the housing 6, 7 with a fastener 4. The top drive TD can be turned in either direction with the string weight hanging without risk of release of the slips. The driller can watch the weight indicator to determine that the hanging condition of the string is maintained before operation of the top drive TD in rotation.

It should be noted that spring 5 is optional and the same result can be obtained by moving a precise distance in either or both opposed directions with the top drive to get the desired engagement that allows slip extension or tubular rotation with the weight of the string hanging off the top drive as well as the release of the slips from the string when needed.

In order to release from the string 14 after filling and circulating through the string 14 as it is advanced into the borehole, slips on the rig floor (not shown) are set to support the string 14 from the ring floor and allow weight to be set down by lowering the top drive TD so that the FIG. 3 position is resumed. At this point the top drive TD is made to rotate driving nut 1 and the driven nut 2 in the opposite direction than the direction that set the slip segments 46 to make the actuator 10 move back axially in a downhole direction to allow the slip segments to radially retract. When the actuator 10 moves down it will pull the slip segments 46 inward for a grip release.

Those skilled in the art will appreciate that spring 5 can take different forms such as a sealed volume with compressible gas inside or a stack of Bellville washers for example. The top sub 3 can be a guide for the axial movement of the actuator 10 while conducting flow through the cup seal 12. The rotational lock with balls 9 can be splines or other structures. The design is simple and can be built economically for reliable operation. Setting down weight allows extension or retraction of the slips when accompanied by rotation from the top drive. Without setting down weight and rotating the top drive with the slips extended the tubular supported by the slips turns in tandem with the housing 6,7 and the slips 11 that is non-rotatably attached to it.

FIGS. 9-14 show two main differences from U.S. Pat. No. 9,416,601 with regard to spline alignment and a locking feature. Common components will have the same item number although some parts are modified such as driven nut 2 and housing 7 to incorporate anti-locking mechanism. Driven nut 2 is secured in the housing 7 so that axial relative travel is limited.

Figures 9, 11, 13:
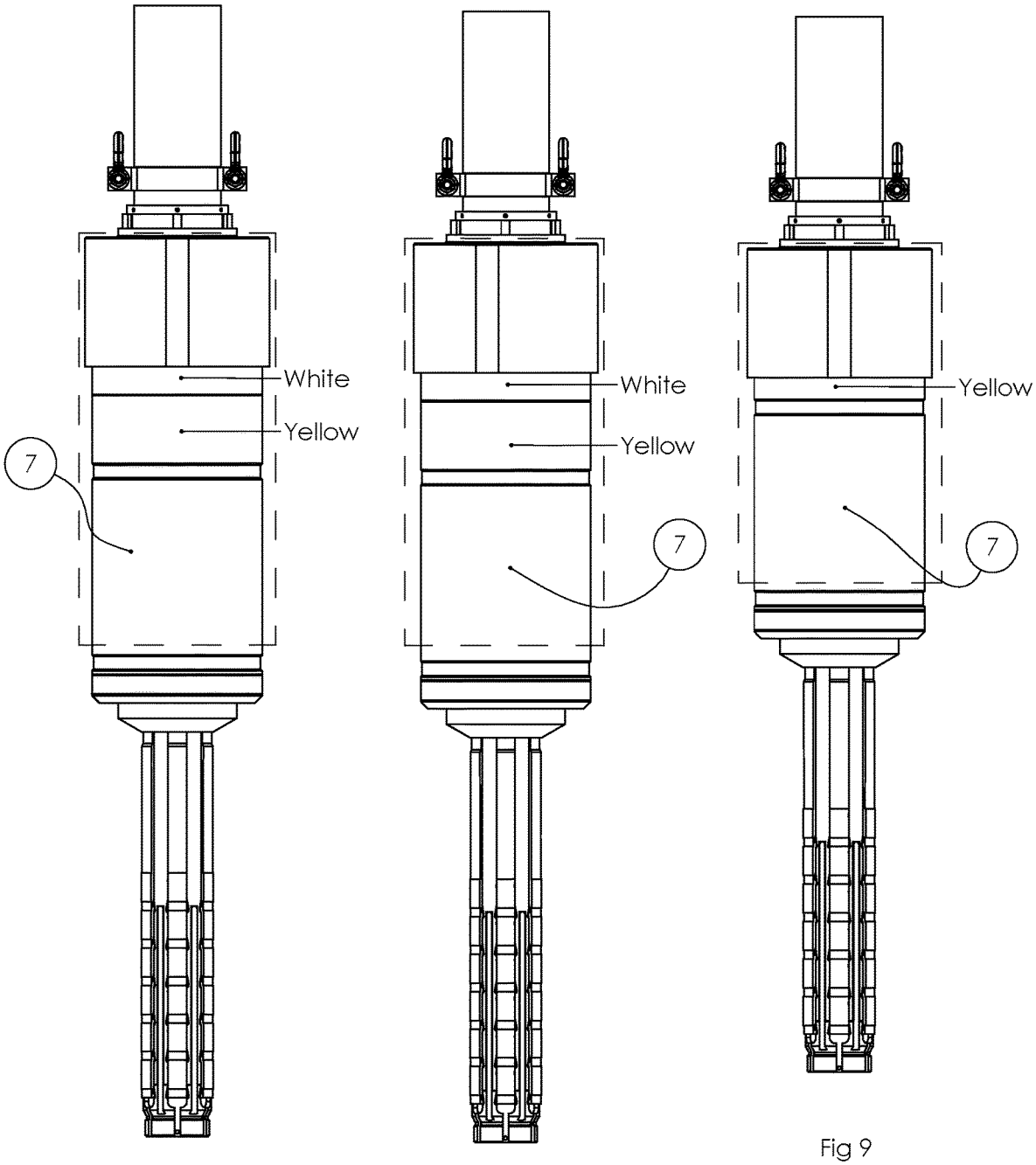
FIG. 9 is an outside elevation view of the running tool in the unlocked position for insertion into a tubular to be supported.
FIG. 11 shows the tool in the slips extended position with a subsequent pickup force applied.
FIG. 13 is an outside view of the tool in the fully locked position such that relative axial component movement is prevented and rotation that keeps the lug on the ledge is possible without releasing the grip on the tubular.
Figure 10:
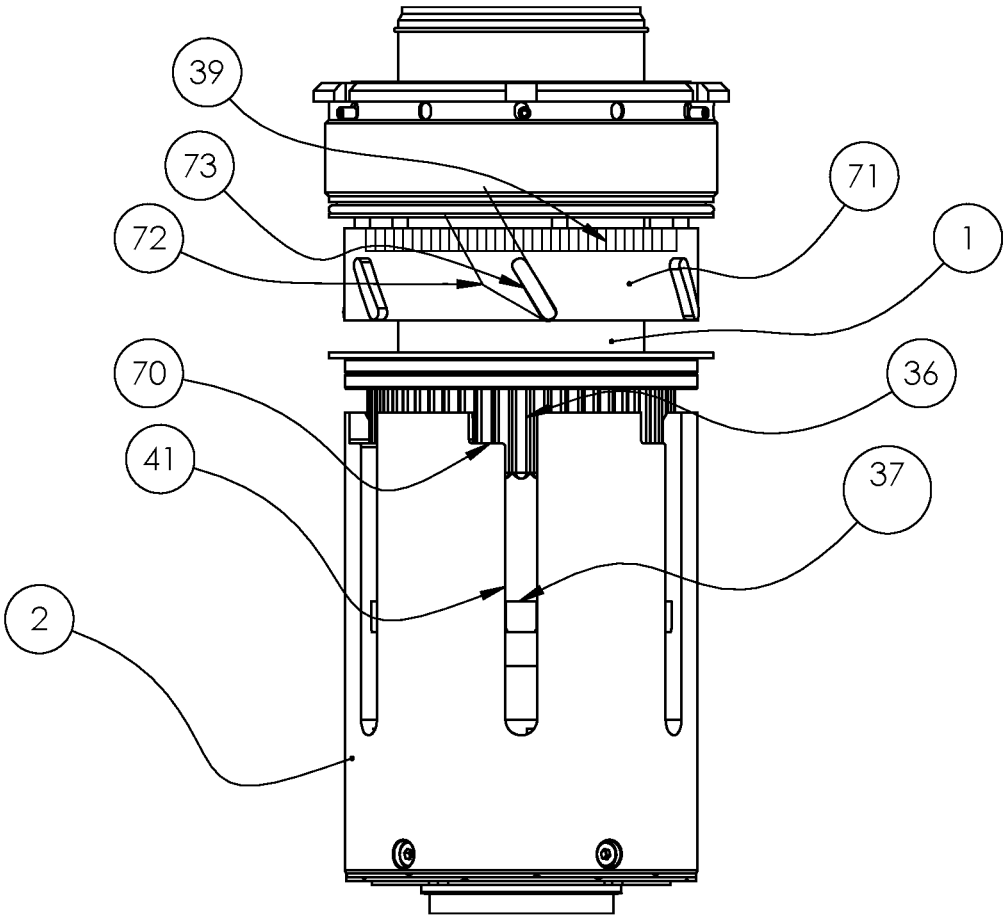
FIG. 10 an elevation view of the drive assembly without an outer housing to show the internal components.

FIG. 9 shows the unlocked position. FIG. 10 is detailed section view of the tool showing the internal components in the unlocked position. Driven nut 2 is modified to have horizontal slot 70. Clutch 71 has outer spline 73 and inner spline 39. Housing 7 has spline 72 to accomplish alignment of spline 39 by rotating clutch 71 along a sloping surface of spline 72 before spline 36 comes up to mesh spline 39. Spline 36 is an external spline on driving nut 1.

The lug 37 on the driving nut 1 is in the slot 41 of the driven nut 2 in unlocked position of FIG. 10. Spline 36 on the driving nut 1 is un-meshed with clutch spline 39 at this time.

Figure 12:
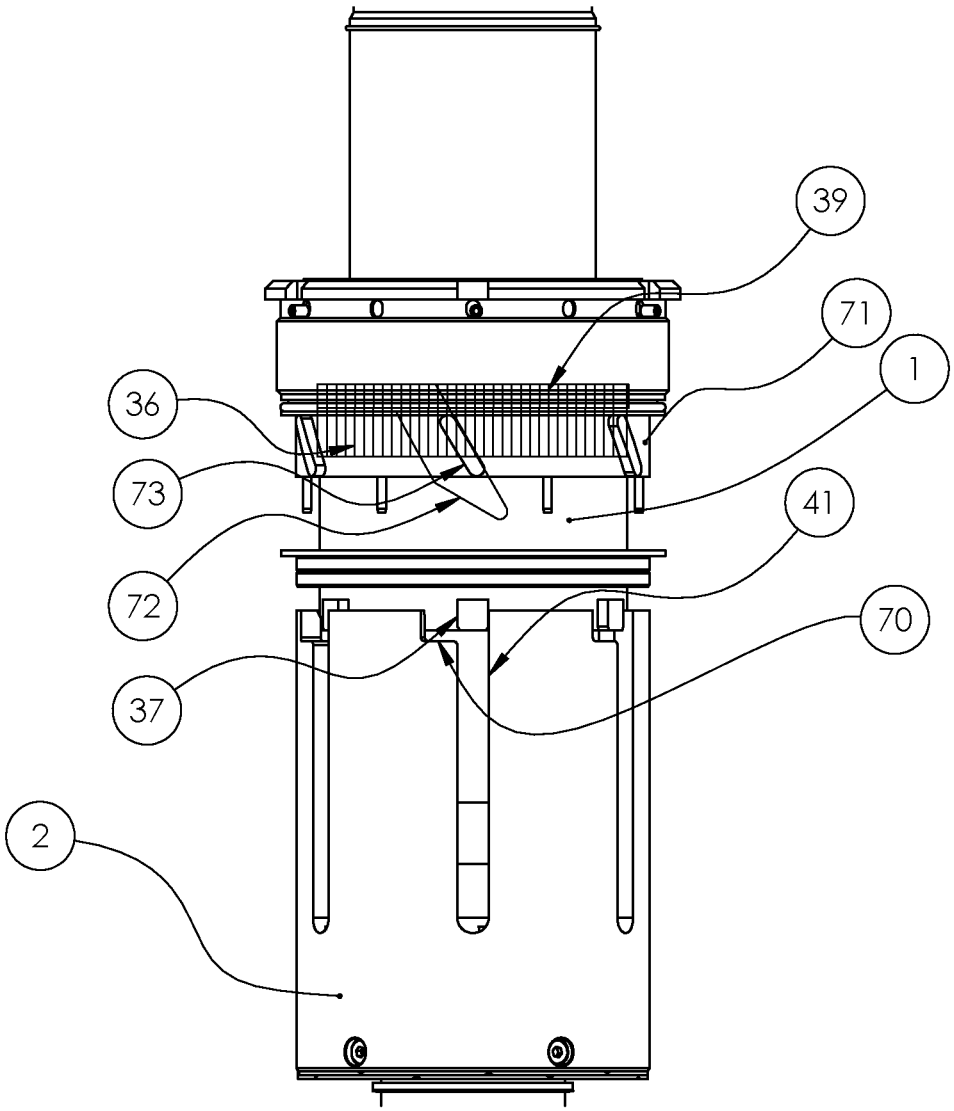
FIG. 12 is the view of FIG. 11 with the outer housing removed showing the lug moved out the top of the slot but before rotation of the lug to a supporting ledge adjacent the slot.
Figure 14:
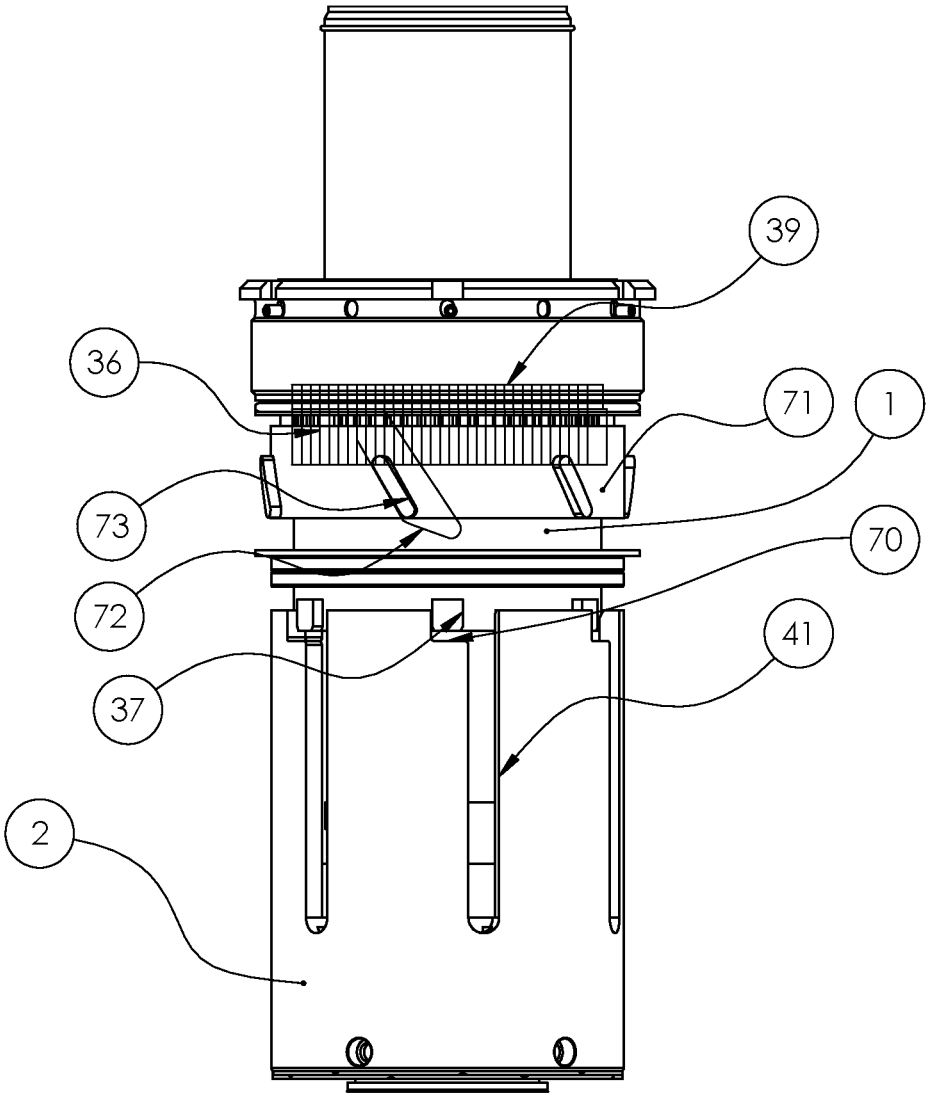
FIG. 14 is the view of FIG. 13 shown without the outer housing showing the lug out of the slot and on a ledge.

FIG. 11 shows the locked position and FIG. 12 is the detailed view of the tool in the locked position where rotation with top drive TD, depending on direction, allows the slip segments 46 to be extended or retracted from the tubular 14. The housing 7 is removed to show the position of the internal parts. In this position rotation of the top drive TD will enhance or release the grip of the slip segments 46 to the tubular 14. The lug 37 on the driving nut 1 is at the top of slot 41 of the driven nut 2 in locked position. Spline 36 on the driving nut 1 is meshed with clutch spline 39. Going from unlocked to locked position with longitudinal translation, lug 37 and slot 41 are continuously meshed. In this position of FIG. 12, the lug 37 is free to reverse direction and if forced to do so coupled with rotation there is a risk of release of the slip segments 46 from the string 14. However, due to the width of spline 72 there is an ability of the lugs 73 to rotate enough to put support surface 70 under lug 37 as shown in FIG. 14. In this position of FIG. 14 splines 36 and 39 stay meshed despite set down weight to prevent release of the string 14 by the slip segments 46.

FIGS. 13 and 14 show the anti-collapse position. The lug 37 on the driving nut 1 is in the horizontal slot 70 of the driven nut 2 in anti-collapse position. Spline 36 is meshed with clutch spline 39. This is accomplished by rotating the driving nut 1 with respect to driven nut 2. Horizontal slot 70 prevents axial translation of lug 37. Without axial translation, splines 36 and clutch spline 39 cannot be uncoupled which prevent release of slip from the tubular. The reason for this is that the clutch 71 can only turn a small distance relative to the housing 7 because of the relationship between its exterior spline 73 and the spline 72 which is on the housing 7. With splines 36 and 39 locked together, rotation of the top drive TD turns the housing 7, the driving nut 1 and the driven nut 2. With all three of those parts turning in tandem, there is no relative rotation that is needed to induce axial movement of the actuator 10 for the slip segments 46. Weight applied by the top drive TD will be carried by the horizontal slot 70. This situation was not the case in U.S. Pat. No. 9,416,601 where the tool was able to change positions with set down weight which if combined with rotation could release the grip of slip segments 46 of string 14.

Disengagement of anti-collapse position of FIG. 14 back to the FIG. 12 and then FIG. 10 positions, is accomplished by reversing the sequence of operations performed to reach the FIG. 14 position.

Those skilled in the art will appreciate that the present invention allows for selective grip of a tubular string and then locking that position despite applied set down weight when manipulating the string in the hole such as when the string sticks on an obstruction, for example. The positioning of the horizontal slot or support surface 70 to the left of slot 41 insures that when the top drive TD is turned to the right with set down weight that the FIG. 14 position will be held and the slip segments 46 will not release the string 14. The horizontal slot could also or alternatively be positioned to the right of slot 41 to accomplish the same results when weight is set down and rotation is to the left or counter-clockwise, but most operators prefer not to rotate in that direction due to the risk of loosening a threaded joint. Additionally, opposed horizontal slots can make alignment difficult as between lug 37 and slot 41.

The above description is illustrative of the preferred embodiment and many modifications may be made by those skilled in the art without departing from the invention whose scope is to be determined from the literal and equivalent scope of the claims below:

I claim:

1. A top drive operated tubular running tool assembly, comprising:

a housing supported by the top drive;

a gear driven assembly comprising a driving nut and a driven nut in said housing to selectively transmit rotational input from the top drive and convert such rotation to axial movement of an actuator member operably linked to at least one slip for selective grip and release of a tubular by said at least one slip;

said selective transmission of rotational input comprises a clutch disposed between said housing and said driving nut;

said clutch further comprising a lock for selectively locking said at least one slip engaged the tubular by preventing rotational input from said top drive from being converted to axial movement of said actuator member through said gear driven assembly to allow axial loading and rotational loading of said housing from said top drive in at least one direction without release by said at least one slip of the tubular;

wherein said lock comprises a lug in an axial slot further comprising a horizontal slot extending in at least one direction from said axial slot to define a support surface support surface and said lock prevents relative axial movement between said clutch and said driving nut and said driven nut.

2. The assembly of claim 1, wherein:

said axial slot is disposed on said driven nut and said lug is disposed on said driving nut.

3. The assembly of claim 1, wherein:

said lug remains on said support surface when said housing is turned clockwise, to the right, by the top drive or if weight is set down on said housing from the top drive with said lug on said support surface.

4. The assembly of claim 1, wherein:

said clutch comprises a rotatably mounted ring with a clutch spline disposed on an inside surface of said ring, said ring axially movable in said housing while rotating due to at least one inclined lug on an outer surface of said ring engaging an inclined slot on said housing to align said clutch spline and a spline on said driving nut before meshing said clutch spline with said driving nut spline.

5. The assembly of claim 1, wherein:

said clutch turns with said housing, whereupon selective engagement of said clutch to said driving nut, said housing, said driving nut and said driven nut are rotated in tandem by the top drive which tandem rotation prevents relative rotation between said driven nut and said actuator member which is otherwise necessary to move said actuator member axially for movement of said at least one slip toward or away from the tubular.

6. The assembly of claim 1, wherein:

said gear driven assembly converts rotational input from the top drive into axial movement of said actuator member using a threaded connection therebetween.

7. The assembly of claim 1, wherein:

said gear driven assembly is selectively rotationally locked to said housing under the force of a bias.

8. The assembly of claim 1, wherein:

said at least one slip has an elongated shape with a plurality of driven ramps that are in alignment with a plurality of driving ramps on said actuator member.

9. The assembly of claim 1, wherein:

said clutch is biased to a first position where rotation of the top drive will not move said actuator member axially.

10. The assembly of claim 9, wherein:

said bias is overcome with set down weight on the driving nut that at least in part acts as said clutch.

11. The assembly of claim 9, wherein:

said bias is accomplished with a coiled spring.

12. The assembly of claim 9, wherein:

axial movement of said driving nut against said bias maintains engagement with said driven nut for tandem rotation while disengaging said driving nut from said housing.

13. The assembly of claim 12, wherein:

rotation of said driven nut drives said actuator member axially.

14. The assembly of claim 13, wherein:

said driven nut is operably connected to said actuator member by a thread.

15. The assembly of claim 14, further comprising:

a top sub adapted to be connected to the top drive and rotationally locked to said driving nut.

16. The assembly of claim 15, wherein:

said driving nut and said driven nut are rotationally locked to said housing under a force provided by said biasing.

17. The assembly of claim 16, wherein:

said driving nut is released from being rotationally locked to said housing with a set down force that overcomes said biasing.

18. The assembly of claim 17, wherein:

said at least one slip retains the tubular with said at least one slip extended when the weight of said tubular is supported by said at least one extended slip such that rotation of said housing by the top drive rotates the tubular.

* * * * *